US009165540B1

(12) United States Patent
Bortz

(10) Patent No.: US 9,165,540 B1
(45) Date of Patent: Oct. 20, 2015

(54) DEVICE FOR REMOVING MOISTURE FROM A WOODWIND INSTRUMENT

(71) Applicant: Jodi R. Bortz, Chestertown, MD (US)

(72) Inventor: Jodi R. Bortz, Chestertown, MD (US)

( * ) Notice: Subject to any disclaimer, the term of this patent is extended or adjusted under 35 U.S.C. 154(b) by 0 days.

(21) Appl. No.: 14/311,475

(22) Filed: Jun. 23, 2014

(51) Int. Cl.
*G10D 9/00* (2006.01)

(52) U.S. Cl.
CPC ..... *G10D 9/00* (2013.01)

(58) Field of Classification Search
CPC ..... G10D 9/00
See application file for complete search history.

(56) References Cited

U.S. PATENT DOCUMENTS

| | | | | | |
|---|---|---|---|---|---|
| 1,421,529 | A * | 7/1922 | Millhouse | 15/160 |
| 1,730,785 | A * | 10/1929 | Romao | 15/211 |
| 2,537,149 | A * | 1/1951 | McKean | 15/211 |
| 3,488,790 | A * | 1/1970 | Fusao | 15/118 |
| 3,739,420 | A * | 6/1973 | Kafkis | 15/211 |
| 4,114,504 | A * | 9/1978 | Koregelos | 84/453 |
| 5,060,336 | A * | 10/1991 | LaLonde | 15/104.095 |
| 5,212,332 | A * | 5/1993 | Gigliotti | 84/453 |
| 5,555,588 | A * | 9/1996 | Viesehon | 15/104.16 |
| 6,005,179 | A * | 12/1999 | Currie | 84/453 |
| 7,030,306 | B1 * | 4/2006 | Chang | 84/453 |
| 2009/0211049 | A1 * | 8/2009 | Fields | 15/210.1 |
| 2014/0360337 | A1 * | 12/2014 | Hutchinson, Sr. | 84/397 |

* cited by examiner

*Primary Examiner* — Robert W Horn

(57) ABSTRACT

Device for removing moisture from a woodwind instrument are disclosed. The woodwind cleaner is comprised of a semi-rigid inner wire, encased in absorbent material, then enclosed in a soft, absorbent outer covering. When not in use, the device can be coiled or wrapped around itself for easy storage, then easily returns to full length for use. The device can be used to clean the moisture from an instrument without disassembling it. The device is intended to be stored outside the case and to be easily portable.

2 Claims, 4 Drawing Sheets

DEVICE FOR REMOVING MOISTURE FROM A WOODWIND INSTRUMENT

BACKGROUND

1. Field of Invention

This device is designed to clean moisture out of the inside of a woodwind instrument, but it can be used on other instruments. When performing on a woodwind instrument, it is very common for the instrument to become saturated from the moisture in the player's breath. The keys of the instrument may begin to stick, may make a clicking sound, and moisture may leak out through the open key holes. It is not uncommon to find the need to swab an instrument several times during a performance. To do this, given current methods, the instrument must be taken apart. This is impractical during performance as there may be insufficient time, and when re-assembled it may no longer be in tune with other instruments in the ensemble. The device allows the performer to swab the instrument without disassembling it, thus preserving the tuning of the instrument.

2. Description of Prior Art

Flutes and piccolos have traditionally been cleaned with a wooden or metal stick with a loop at the end. The player feeds a piece of cloth through the loop, then feeds the cloth and device through the individual sections of the instrument. Other woodwind instruments are cleaned by removing parts of the instrument and feeding a rigid device through it or pulling a rag through it. There are some inherent problems with these methods, in particular as it pertains to use during performance.

1. To clean moisture from an instrument using any of these methods, a performer must take the instrument apart.
2. The cloth may bunch up and become stuck in the instrument;
3. The metal or wood of a stick may come in contact with the inside of the instrument and scratch or damage it. Similarly, those devices that clean the instrument by lowering a weighted string and cloth through risk damage from the weight itself.

The Woodwind Cleaning Sleeve, U.S. Pat. No. 6,005,179 to Currie (1999) solves the problem of the size of the cloth and prevents damage, but it still has the following problems:

1. To use the device you must disassemble the instrument, requiring re-assembly and re-tuning of the instrument, which may be impractical during performance.
2. Because the device is not attached to the rod, but only fits over it, it can only be inserted into the instrument in one direction. It cannot be removed by reversing the direction of the insertion.

Similarly, other woodwind cleaners such as U.S. Pat. No. 3,739,420—Device for Swabbing the Bore of a Musical Instrument or U.S. Pat. No. 5,212,332 Swab for Wind Instruments require the instrument to be disassembled and a string/cloth device is inserted. In these examples, the player removes one or more sections of an instrument and feeds a string through that has a swabbing cloth on the end. As in the prior example, the problem remains that disassembling the instrument requires retuning which is impractical during performance.

SUMMARY OF THE INVENTION

The Device for Removing Moisture from Woodwind Instruments is a flexible cleaning device that comes fully assembled and is long enough to swab the entire length of the instrument without taking the instrument apart. It consists of a flexible inner wire that is covered in fabric that can be inserted into and instrument to remove the moisture. Because it is flexible, it can be fed through curves and can be easily coiled to for storage. The wire maintains enough rigidity to allow the user to push the device through the entirety of the instrument.

The device for removing moisture from woodwind instruments resolves several of these problems as follows:

1. The device is flexible, but its base is made of strong bendable wire. The device can be pushed through the instrument and will conform to the curves of the instrument as it goes through. The device can be coiled and stored easily when not in use.
2. It is fully assembled and ready to use. It can be deployed in seconds with minimal disruption during a performance.
3. When uncoiled to its full length, it feeds easily into the full length of an instrument to remove the moisture.
4. The device is one piece, and can therefore be removed by reversing the direction of the swab. It is designed to fit snugly, but not overly so, ensuring the swab does not become stuck inside the instrument.
5. Much care is taken when performing, especially in a group, to align the intonation of the instrument to the other instruments. The device removes the moisture from the instrument without undoing the precise placement and assembly of the instrument, thus preserving the intonation.
6. Because of ease of use, it is practical for use not just during performance, but also during practice or rehearsal.

The inner backbone of the device is made of flexible wire. The wire may be metal or plastic or a combination. The inner padded layer is made of cotton or other absorbent material. The outer layer may be covered in cotton, silk or other material and if the material used is conducive, may be treated with anti-microbial agents to prevent growth of bacteria and to prolong the life of the device. The size and shape can be varied slightly to conform to particular instruments. The device may be made with or without a decorative pendant or handle at one end to aid with insertion. The device is hand washable.

REFERENCE NUMERALS IN DRAWINGS

Figure 1A:
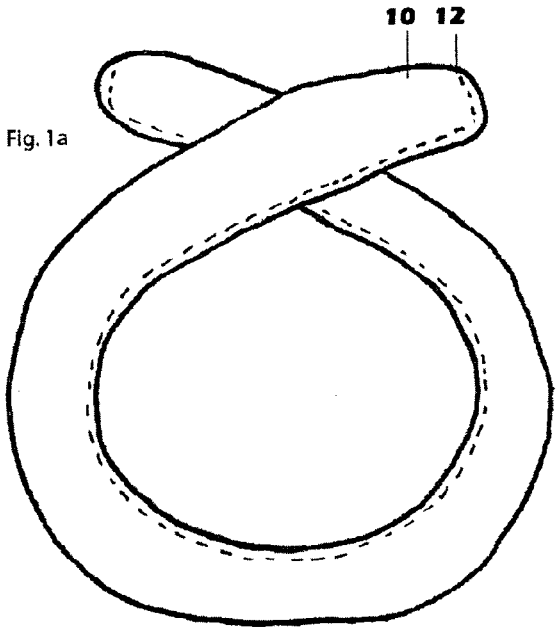
FIG. 1*a* is a view of the device coiled for storage in its straight bore woodwind iteration.

10 Outer fabric of cleaning device
12 Stitching line
14 Pendant/handle
16 Inner wire
18 Protective cap on wire
20 Inner absorbent fabric
22 Musical instrument

SUMMARY

The Device for Removing Moisture from Woodwind Instruments is designed to clean the inside of a woodwind without disassembling the instrument and without scratching or otherwise damaging the inside of the instrument.

Figure 1B:
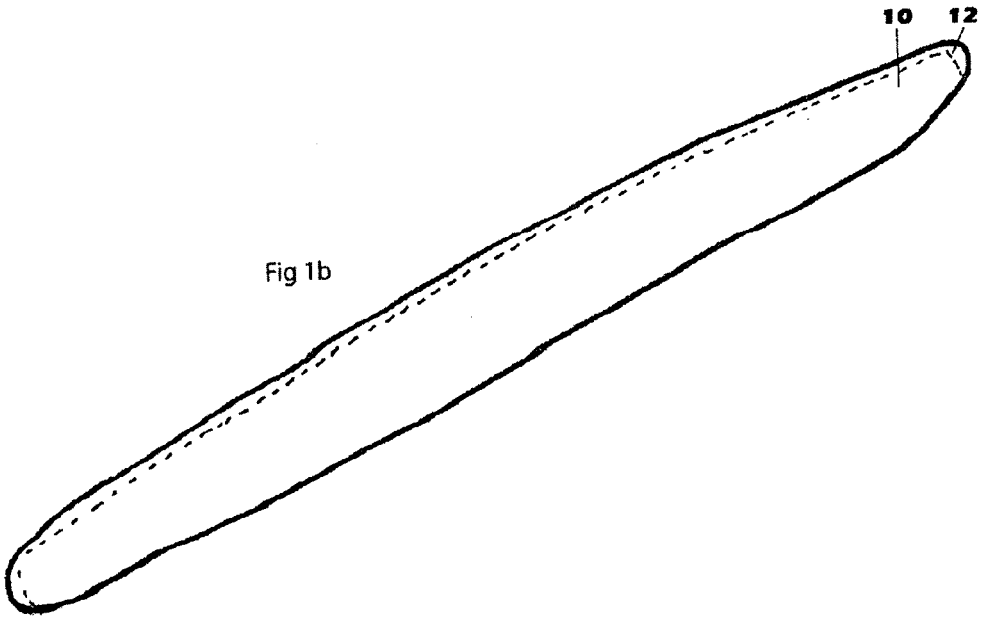
FIG. 1*b* is a view of the flute device uncoiled ready for use in its straight bore woodwind iteration.
Figure 1C:
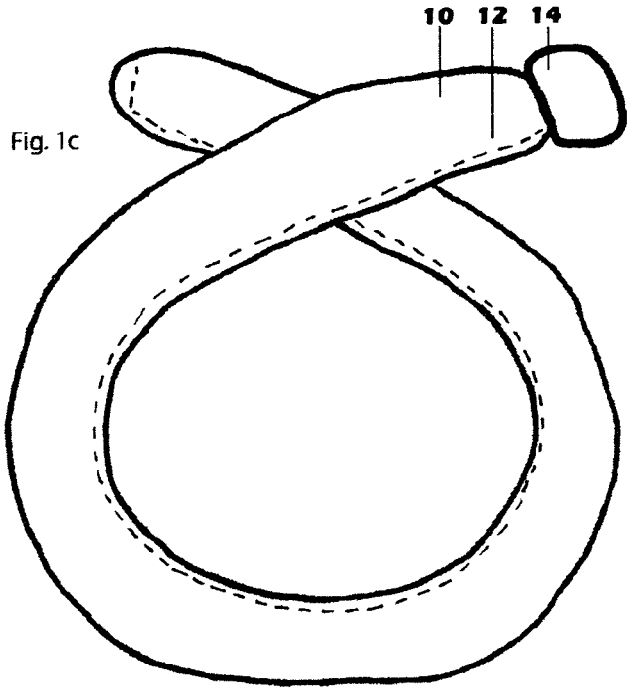
FIG. 1*c* is a view of the device as it appears with a pendant/handle in its straight bore woodwind iteration.

Description FIGS. 1*a*-1*c*

The key improvements over prior technology are the flexibility of the device and the soft covering that prevents damage. FIG. 1*a* shows the device coiled for use with a straight bore instrument such as a flute, demonstrating its flexibility. FIG. 1*b* shows the device fully extended, demonstrating the length of the device. FIG. 1*c*

Shows how the device can be altered to include a handle. This does not alter the use of the device, but shows a variation that may appeal to some users.

Figure 2:
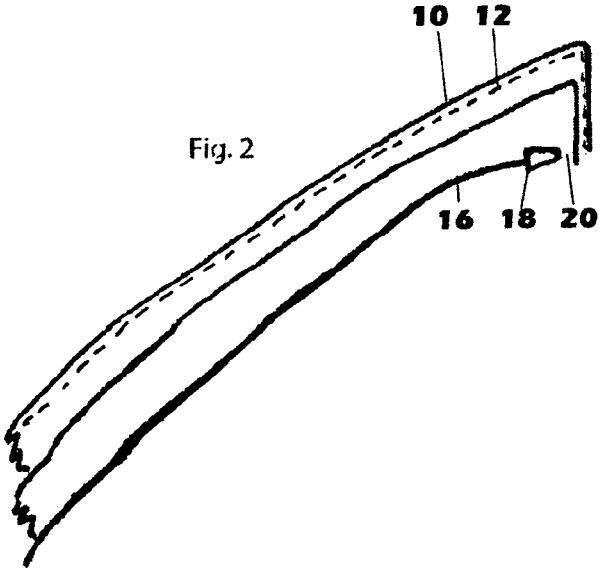
FIG. 2 is a view of the inside of the device showing the assembly of the inside of the instrument.

Description FIG. 2

FIG. 2 shows the assembly of the device. It consists of four (4) parts. The first part 16 is the flexible wire. The wire should be cut so that it is slightly longer than the instrument for which it is intended, approximately one to three inches depending on the size of the instrument. A small plastic cap is added to cover the ends of the wire to ensure it does not poke through the fabric. The next step involves cutting a piece of fabric batting to cover the length of the wire. The wire is then attached to the fabric batting using a heavy duty glue (non-toxic is preferable). The wire and batting is then set aside to dry. To make the covering, a piece of fabric is cut long enough to cover the wire and batting, and that is twice as wide as the intended final diameter. The fabric is then folded over, matching the edges all around. If the fabric has a front and back, the fronts should be facing each other in the fold. Sew one short side and the long side leaving one short side open creating a sleeve. Reverse the sleeve so that the fronts are on the outside and the rough edges are on the inside. When the wire and batting part is completely dry, carefully insert it into the sleeve until it is fully encased. Fold in the open rough edges and sew the final edge shut. If a pendant is being added, one end of the wire should be left out of the final edge and the pendant replaces the plastic cap on that end.

Figure 3:
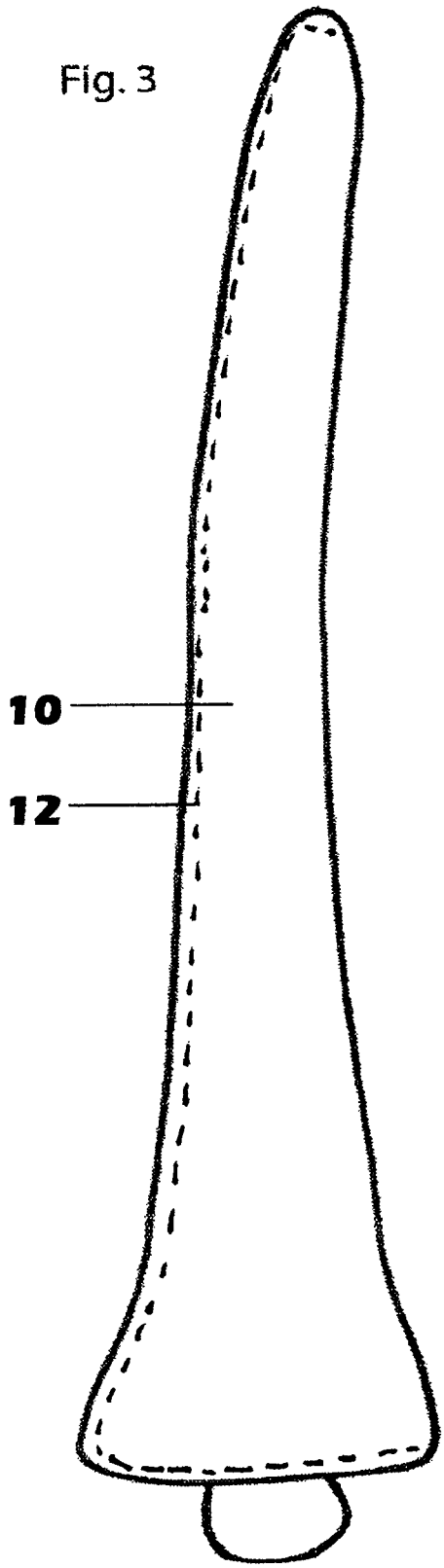
FIG. 3 is a view of the device uncoiled ready for use in its conical bore woodwind iteration.

Description FIG. 3

FIG. 3 shows an example of the device as it would appear for use with a conical bore instrument such as a clarinet or saxophone.

Figure 4:
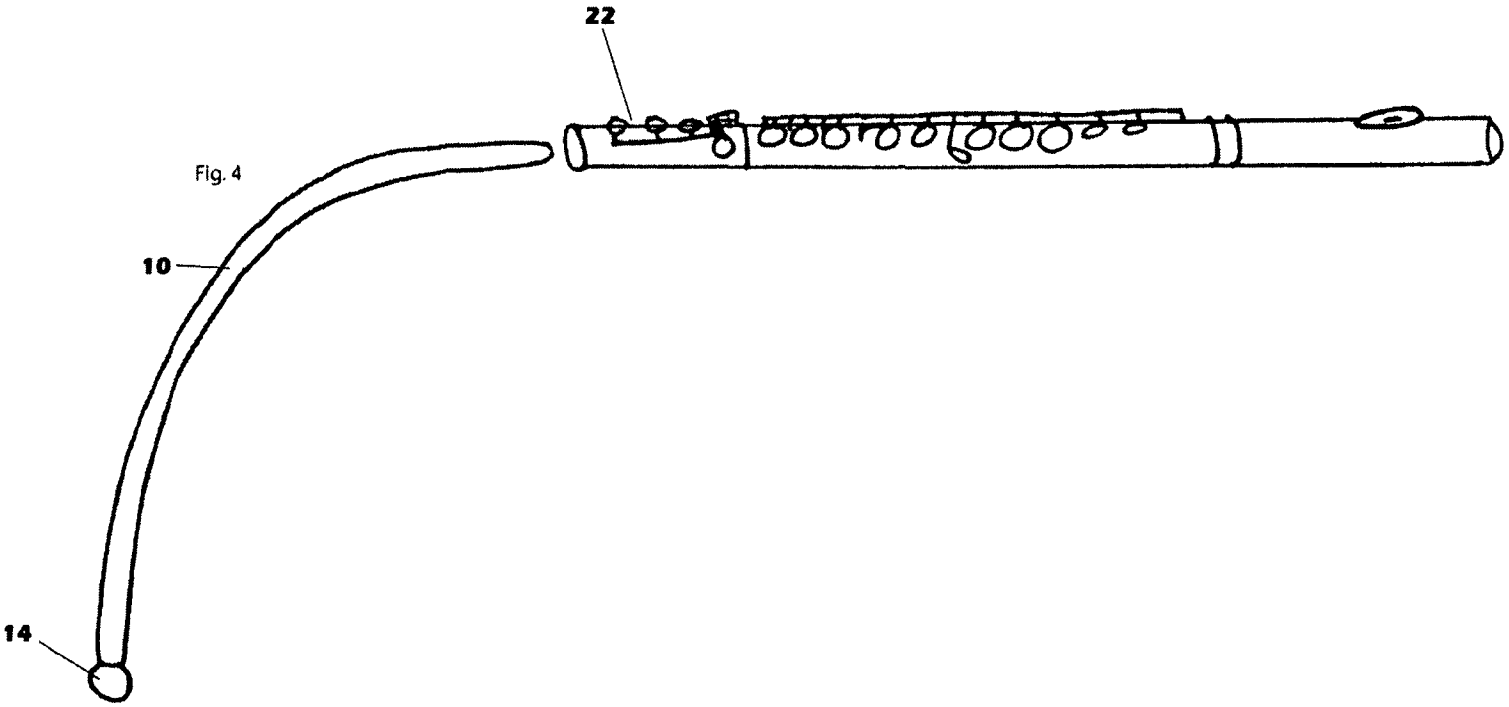
FIG. 4 is a view of the device demonstrating its use with a flute.

Description FIG. 4

FIG. 4 shows the device in use with a flute. The device is uncoiled and inserted into the open end of the instrument. The device is then fed entirely through the instrument. Because it is sized appropriately, it will gently clean any moisture from the inside of the instrument. An important feature is that the front tip of the device cleans all the way to the cap of the flute. This is a common place within the instrument that moisture pools, and most devices do not reach or reach inconsistently. Once the instrument is swabbed, the device is pulled out quickly and easily by reversing insertion. Because the instrument has remained assembled, it is ready to play immediately without further adjustment.

I claim:

1. A device for cleaning moisture from the inside of a woodwind instrument comprising:

(a) a wire sufficient to extend through the entire bore of the intended instrument, capped by a protective cap on both ends;

(b) a fabric batting covering affixed to the wire to cushion the cleaning mechanism that is long enough to completely cover the wire and caps;

(c) a fabric covering that encases the entire device and is the part of the device that comes in direct contact with the inside of the instrument.

2. A device as claimed in claim 1 where a pendant/handle is added in place of one of the end caps.

* * * * *